US005600085A

United States Patent [19]

Schalke et al.

[11] Patent Number: 5,600,085

[45] Date of Patent: Feb. 4, 1997

[54] METHOD OF MANUFACTURING ARMORED TANK HOUSING

[75] Inventors: Jürgen Schalke, Trittau; Erich Pothe, Horneburg, both of Germany

[73] Assignee: Blohm & Voss International, Hamburg, Germany

[21] Appl. No.: 477,423

[22] Filed: Mar. 17, 1983

[51] Int. Cl.[6] ..... F41H 7/04

[52] U.S. Cl. ..... 89/36.08

[58] Field of Search ..... 89/36 H; 29/1.1, 29/1.11; 228/4.1, 6 R, 45, 47, 178, 182

[56] References Cited

U.S. PATENT DOCUMENTS

| | | | |
|---|---|---|---|
| 3,024,704 | 3/1962 | Even | 89/36 H |
| 3,699,842 | 10/1972 | Grewing et al. | 89/36 H |
| 3,918,628 | 11/1975 | Clavey | 228/213 |
| 4,051,763 | 10/1977 | Thomanek | 89/36 H |
| 4,332,012 | 5/1982 | Sekine et al. | 364/468 |

FOREIGN PATENT DOCUMENTS

| | | | |
|---|---|---|---|
| 2810822 | 9/1978 | Germany | 228/47 |

*Primary Examiner*—Michael J. Carone
*Attorney, Agent, or Firm*—Anderson Kill & Olick PC

[57] ABSTRACT

Armored tank housings for all combat, scouting, infantry and supply tanks of different types and sizes and operating as track vehicles are based by selecting a tank housing so that it corresponds to the size of the largest tank size involved. The housing is formed of floor plates, side walls and roof plates. The various plates and walls forming the housing are arranged so that they can be automatically welded together along longitudinal seams. Where transverse seams are required in the floor plates and the roof plates the transverse seams are arranged so that they do not interrupt the longitudinal seams. As required, additional armor can be mounted on the side walls and the roof plates. The housing is arranged so that the components for movement, for orientation and for military tasks are located at the same locations in the housing for all of the different types and sizes of tanks for which the housing is intended.

6 Claims, 3 Drawing Sheets

METHOD OF MANUFACTURING ARMORED TANK HOUSING

Figure 1:
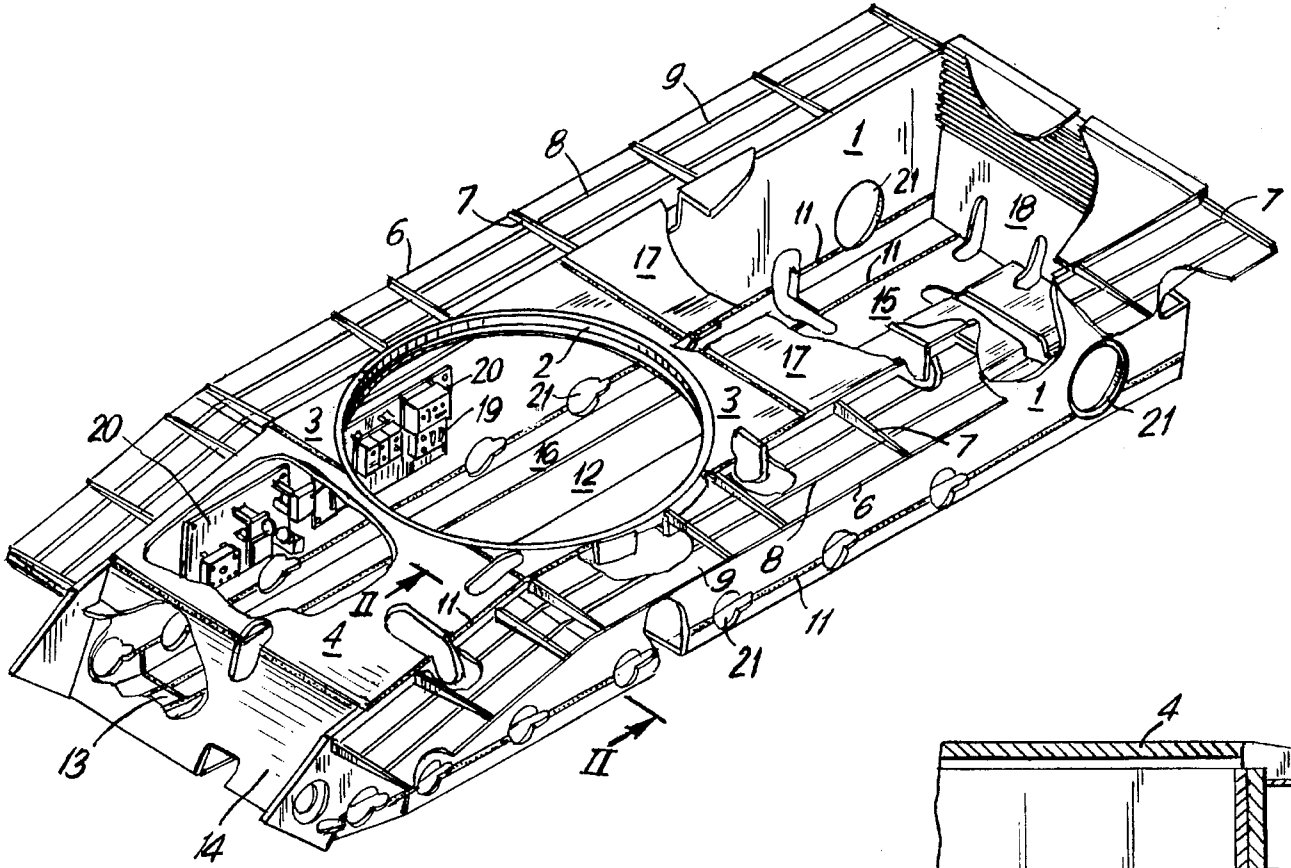

The invention relates to a method of manufacturing armored tank housings for combat tanks, scouting tanks, infantry tanks, supply tanks etc. constructed as track vehicles.

The previous tank housing for track vehicles, i.e., primarily for military vehicles, were projected, with respect to all their parts, with a view to great combat power, i.e., good arming and good protection and, also, low weight and high speed, without regard to price. In contrast, in accordance with the invention, low-cost mass production should stand in the foreground and the significance of low weight should recede while retaining the combat power.

For the purpose of solving this task it is provided that the size of the tank housing for all tank types corresponds to the size of the largest tank and, in selecting the plate dimensioning, plate shapes and material strengths, a low-cost and chiefly automated mass production is extensively taken into consideration; that the attachment of an adapted or integrated special armor is possible and that the components for movement and orientation and for the military tasks are in each case the same and are provided in the housing at the same position in the space.

In a further development of the invention a very substantial characteristic feature of the solution consists in that the course of the welding seam and the seam cross-section between all housing plates, e.g., between the side wall and floor and between the side wall and forward or rear roof plate, are constructed in such a way that they are automatically weldable.

The elimination of manual labor through machines in the very extensive welding connections, as well as the employment of the most uniform possible material, in that one employs armor material of the most uniform thickness possible in not more than two hardness qualities in the front and rear, at the sides and for the roof of the housing in all tank housings, according to a further suggestion of the solution, and, finally, a plurality of structural simplifications—all these serve a low-cost mass production without reducing combat power.

A further step for low-cost mass production consists in that the basic or standard vehicle is produced with armor plates which correspond to the lowest stage of protection. Any desired, required stage of protection can then subsequently be achieved with the aid of special armoring. Finally, a rectangular engine space cover avoids the previous problems of sealing and fitting during assembly and, moreover, this cover, according to the invention, forms a straight, i.e., even surface with the entire tank cover.

Figure 2:
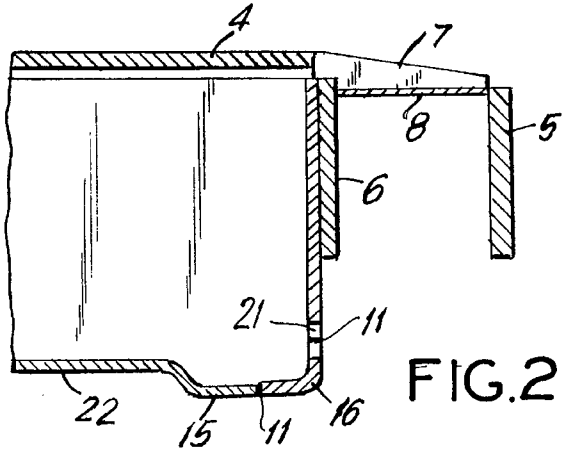
Figure 3:
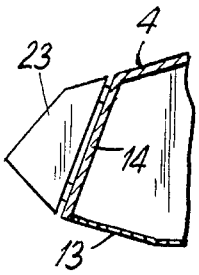
Figure 4:
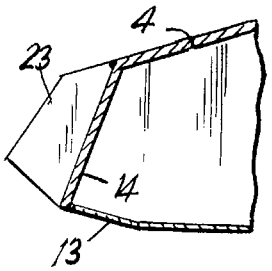
Figure 5:
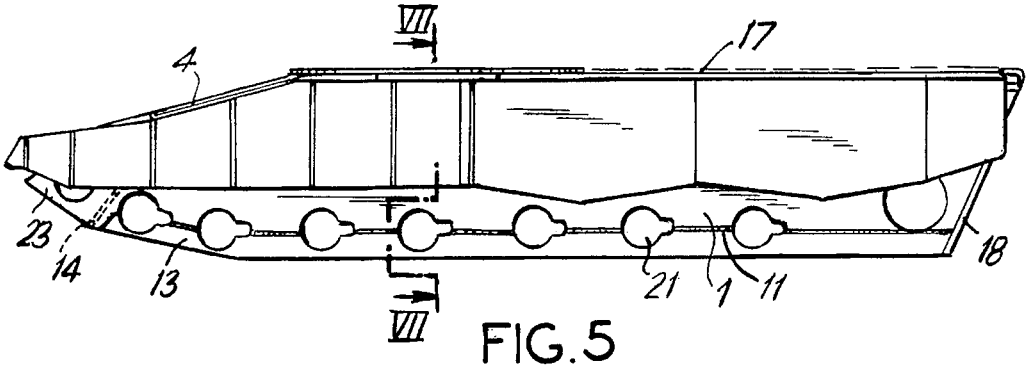
Figure 6:
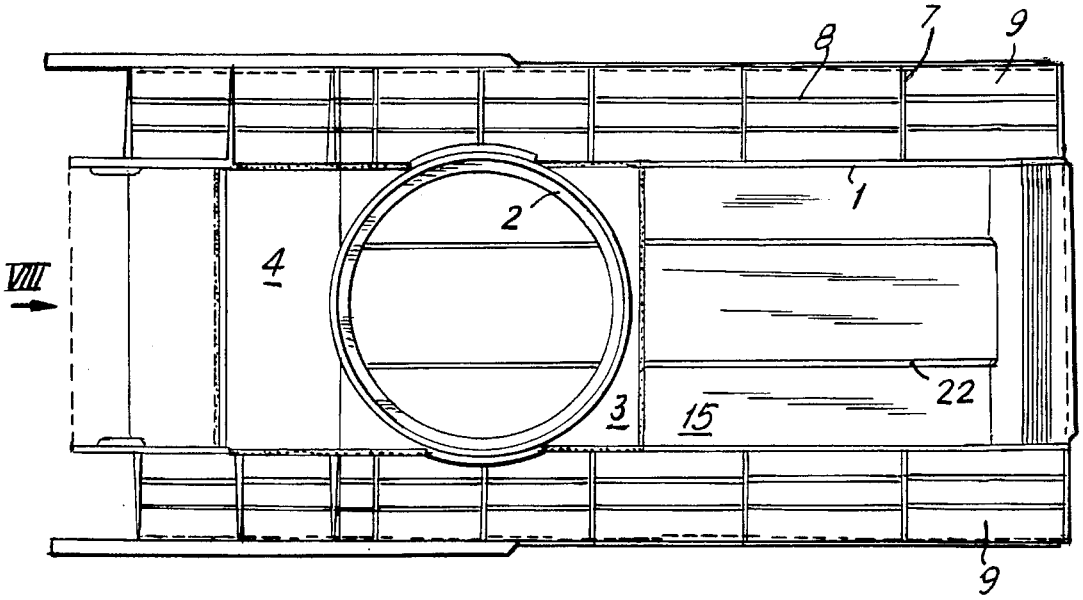
Figure 7:
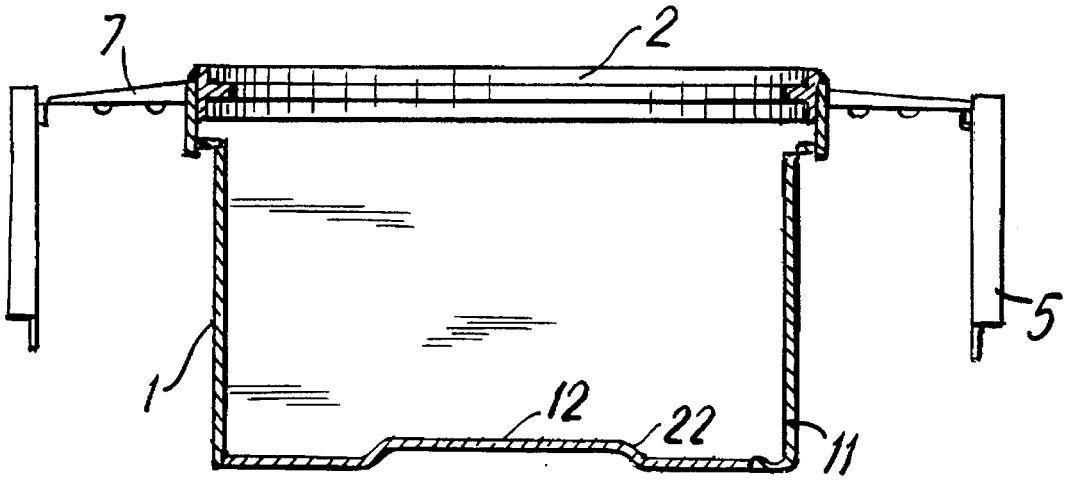
Figure 8:
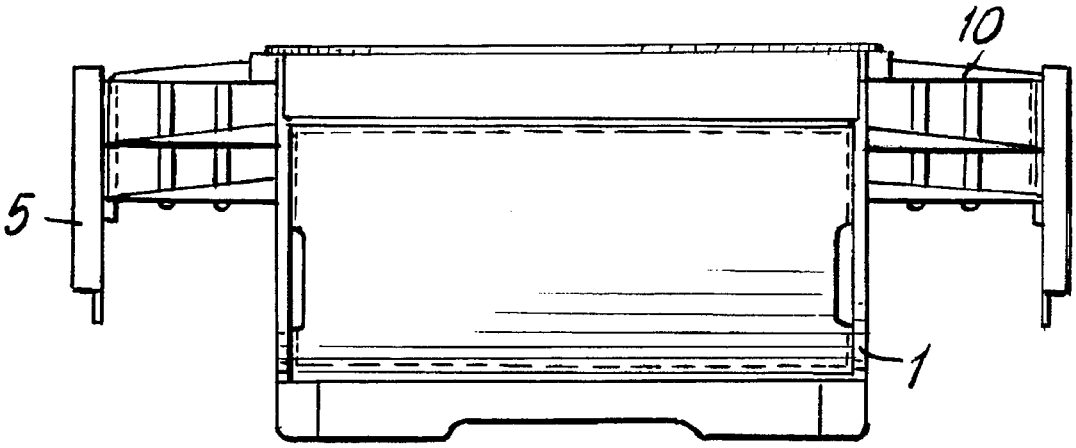

The invention is shown with the aid of an example in the drawing. Shown are:

FIG. 1 a perspective view of a tank housing manufactured in accordance with the method according to the invention in perspective view, partially in section and seen diagonally from the front and above, FIG. 2 one-half of a section according to line II—II of FIG. 1, FIGS. 3 and 4 an adapted and an integrated special armoring of the front bulkhead, FIGS. 5 and 6 a tank housing according to the invention in longitudinal section and in a view from above, FIG. 7 a section along line VII—VII in FIG. 5 and FIG. 8 a view of the tank housing according to FIGS. 5 and 6 seen from the front.

As illustrated by FIG. 1, the side walls of the tank housing are designated with 1, the carrying ring for the gun turret (not shown) is designated by 2, the center and front roof plate is designated by 3 and 4, the center and front and rear floor plate by 12, 13 and 15, the angular extruded section between the floor and side wall by 16, the engine space cover by 17 and the rear wall by 18. The long welding seams, which can be carried out by means of machines and which connect these structural component parts particularly in the longitudinal direction, are designated everywhere by 11.

FIG. 2 shows the enlarged side cases or bracket carriers 7 for carrying the track apron 5, i.e., the track guard, with seams 8 in the track cover plate 9. The bracket carriers can be attached by means of screws or welding so that they can be detached or supplemented above the tracks independently of the construction of the tank housing. The side armor 6 and the roof plate 4 are in this case carried out as additional special armoring. The angular extruded section 16 extending continuously along the housing length connect the side wall 1 with the floor plate 15 with the aid of continuous welding seams 11, and has openings 21 for undercarriage parts, guide rollers and drive elements. The undercarriage parts can be directly worked into the side wall without the structural steel elements and foraging parts previously needed. The floor plate 15 is strengthened by means of longitudinal seams 22 which, in contrast to previously employed transverse seams, do not interrupt the longitudinally extending welding seams 11, i.e., make it possible to employ welding machines. The angular extruded section is provided in place of the so-called flange plates.

FIG. 8 shows another embodiment form above the track (not shown). In this case, side cases 10 are provided above the track. In order to make possible this embodiment as desired, it is principally provided, according to the invention, to raise up the side wall of the housing—in contrast to the previous construction of the tank housing—upto the cover plate of the tank housing, as is better seen in FIG. 2.

FIG. 1 is adapter plates 20 at the inner surface of the side wall 1 provided for a rapidly completable assembly of components or individual structural component parts 19 of all types. Finally, FIGS. 3 and 4 show two possibilities for fastening a special armor 23 at the front bulkhead 14. The components or individual structural component parts can be fastened by means of an adapter plate. The engine space cover 17 is fastened rectangularly and flush on the side wall.

We claim:

1. Method of manufacturing armored tank housings for use in all combat, scouting, infantry and supply tank types of different sizes and operating as track vehicles, comprising the steps of selecting the size of the tank housing for the range of tank types to correspond to the size of the largest tank size with the housing having a long direction extending in the direction of travel on the tracks and a short direction extending transversely of the long direction and the housing having a front end, a rear end spaced in the long direction from the front end, forming the roof of the tank housing of a front roof plate extending from the front end toward the rear end of the housing followed by a center roof plate and welding the front roof plate and the center roof plate together along a weld seam extending in the short direction of the housing, forming the bottom of the housing of a front floor plate extending from the front end toward the rear end of the housing followed by a center floor plate and a rear floor plate extending to the rear end of the housing and welding the front floor plate to the center floor plate and the center floor plate to the rear floor plate along weld seams extending in the short direction of the housing with each of said front, center and rear floor plates forming a part of spaced bottom edges extending in the long direction of the housing, providing an elongated side wall along each side of the housing extending in the long direction with the side walls extending upwardly between the bottom of the housing and the roof of the housing, providing an angular extruded section extending along and between the bottom edges of said floor plates extending in the long direction and the lower edges of said side walls extending in the long direction, welding said floor plates and said side walls to the extruded section along longitudinally extending seams extending in the long direction of the housing so that the transverse seams in said floor plates do not traverse such longitudinally extending weld seams, welding the upper edges of the side walls to the roof with the weld seams extending in the long direction and providing openings located along the junction of the lower ends of said side walls and said extruded section for positioning therethrough components for movement, for orientation and for military tasks in the same locations in said housing for each tank type.

2. Method, as set forth in claim 1, further including the step of automatically welding the side walls to the roof plates and to the extruded sections and the floor plates to the extruded sections.

3. Method, as set forth in claim 1 or 2, further including the step of using a uniform thickness plate for the roof, side walls and the bottom of the housing and using plates not formed of more than two hardness qualities.

4. Method, as set forth in claim 1, further including the step of fixing special armor to the roof plate and to the side walls.

5. Method, as set forth in claim 1 or 2, further including the step of detachably mounting bracket carriers for the track apron from the housing.

6. Method, as set forth in claim 1 or 2, including the step of forming an engine space cover between said center roof plate and the rear end of the housing, and welding the engine space cover along a rectangular seam to the center roof plate, the rear end wall and to said side walls and locating the engine space cover flush on said side walls.

* * * * *